US006581768B2

(12) United States Patent
Young et al.

(10) Patent No.: US 6,581,768 B2
(45) Date of Patent: Jun. 24, 2003

(54) DESKTOP STORAGE DEVICE

(75) Inventors: China Young, New York, NY (US); Jude Pauli, Altadina, CA (US)

(73) Assignee: Loop Licensing Co., Inc., Hanover, NJ (US)

( * ) Notice: Subject to any disclaimer, the term of this patent is extended or adjusted under 35 U.S.C. 154(b) by 57 days.

(21) Appl. No.: 09/778,162

(22) Filed: Feb. 7, 2001

(65) Prior Publication Data

US 2002/0104771 A1 Aug. 8, 2002

(51) Int. Cl.[7] ..... B65D 85/28

(52) U.S. Cl. ..... 206/371; 206/214; 206/523; 211/69.1

(58) Field of Search ..... 206/214, 371, 206/224, 349, 361, 523; 211/69, 69.1, 69.3, 60.1, 69.5

(56) References Cited

U.S. PATENT DOCUMENTS 857,763 A * 6/1907 Smith ..... 211/69
1,541,672 A * 6/1925 Tulay ..... 211/69
4,972,947 A * 11/1990 McCarthy ..... 206/214
5,009,336 A * 4/1991 Liaw ..... 206/214
5,082,119 A * 1/1992 Bingley ..... 211/69.1
5,244,700 A * 9/1993 Banschick ..... 211/60.1
5,509,527 A * 4/1996 Wang ..... 206/214
5,522,498 A * 6/1996 Chang ..... 206/214

* cited by examiner

*Primary Examiner*—Luan K. Bui

(57) ABSTRACT

A desktop storage device is provided comprising an elongated platform element adapted to be inserted and retained within an elongated container. The elongated platform element includes a lower platform upon which said pens, pencils and similar elongated objects rest, and an upper platform connected to the lower platform by means of an elongated connecting member. Disposed within the upper platform is at least one aperture, said aperture serving to allow the pens or pencils to be inserted therethrough, and further allowing the user to grasp the elongated platform in order to slide it out of the container. The elongated platform element is adapted to be inserted into and securely retained within the container. Pens and pencils may be inserted through the aperture in the upper platform, and thereupon come to rest on the lower platform, being bound by the interior surface of the container. In order to receive said pens, pencils and the like, the elongated platform element is withdrawn from the container by means of grasping the aperture, thereby exposing the items stored within the container. In the preferred embodiment, the desktop storage device is composed of a foam rubber-type material, which material provides the storage device some flexibility and protection from everyday wear and tear.

9 Claims, 1 Drawing Sheet

DESKTOP STORAGE DEVICE

BACKGROUND OF THE INVENTION

1. Field of the Invention

The present invention relates generally to a desktop storage device for pens, pencils and similar elongated objects, and more particularly, to a desktop storage device comprising an elongated platform element for said pens, pencils and the like, said elongated platform adapted to be inserted and retained within an elongated container. The elongated platform element includes a lower platform upon which the pens and pencils rest, and an upper platform connected to the lower platform by means of an elongated connecting member. Disposed within the upper platform is at least one aperture, said aperture serving to allow the pens or pencils to be inserted therethrough, and further allowing the user to grasp the elongated platform in order to slide it out of the container. In order to store said pens and pencils, the elongated platform element is inserted into the container, and the pens and pencils are inserted through the aperture in the upper platform. The pens and pencil come to rest on the lower platform and are bound within the interior surface of the container. In order to receive said pens, pencils and the like, the elongated platform element is withdrawn from the container by means of grasping the aperture, thereby exposing the items stored within the container. In the preferred embodiment, the desktop storage device is composed of a foam rubber-type material, which material provides the storage device some flexibility and protection from everyday wear and tear.

2. Description of the Prior Art

Devices to aid in the organization of desktops are of particular concern in the modem age, where the available work surface on desks is diminishing as a result of computers, telephones, and the like taking up a large percentage of the desk surface. In addition, peripheral items such as mouse pads, lamps, staplers, pictures and books all compete for space on the desktop. Desk drawers may be used to store some of these items; however, such items tend to get lost in the clutter of the drawers.

Organizers storing and organizing pens, pencils, and similar elongated desktop items have traditionally involved nothing more than a plastic cup or the like. Aesthetically, however, cup-type containers are not very appealing, and all of the cup's contents are displayed in a disorganized stated. In addition, such cup-type containers tend to be easily overturned, thereby depositing the contents of the container on the desk or floor. Various devices for storing and retaining pens, pencils and the like have therefore been developed in order to overcome the failings of the simple cup-type container.

For example, U.S. Pat. No. 5,544,764, which issued to Cima on Aug. 13, 1996 for a "Holder for pens, pencils, tools, or the like" discloses a holder for pens, pencils, elongated tools and the like, having a body provided with a plurality of parallel, elongated chambers extending downwardly through an upper surface. The body has an upper surface at an inclined angle to the parallel, elongated, chambers so that the chambers are accessible through elongated openings at the upper surface. The body can be produced by any desired technique, such as molding or machining, or can be produced by providing a plurality of tubular elements bonded together in a side-by-side abutting relationship.

Similarly, U.S. Pat. No. 4,310,109, which issued to Coyle on Jan. 12, 1982 for a "Pencil holder" discloses a pencil holder having a main body which is adapted to fit within a shirt pocket and having a multi-biased spring that releasably fastens the pencil holder to the shirt pocket and simultaneously retains pens or pencils placed within the pencil holder.

Furthermore, U.S. Pat. No. 5,509,527, which issued to Wang on Apr. 23, 1996 for a "Convertible pencil box" discloses a container for pencils and the like that is convertible into a bolder for those pencils by reversely folding an outer cover of the container at a position intermediate with lengths to provide two compartments in parallelism with each other, and which are usable as a pencil holder.

In addition to the above-references U.S. utility patents, there are also numerous design patents for desktop storage devices and the like, including U.S. Pat. Nos. D310,244; D397,361; D341,624; D334,949; D327,093; D324,077; D323,853; D311,213 and D299,477, just to name a few.

However, the prior art desktop storage devices fail to offer the unique advantages contemplated by the present invention.

SUMMARY OF THE INVENTION

Against the foregoing background, it is a primary object of the present invention to provide a desktop storage device for pens, pencils and similar elongated objects.

It is another object of the present invention to provide such a desktop storage device that is convenient to use.

It is yet another object of the present invention to provide such a desktop storage device that allows said pens, pencils and similar elongated objects to be hidden from view when not in use.

It is still another object of the present invention to provide such a desktop storage device that is composed of a resilient and flexible material.

It is but another object of the present invention to provide such a desktop storage device that allows said pens, pencils and similar elongated objects to be stored within a container upon a platform, which platform may be raised in order to expose said objects.

It is another object of the present invention to provide such a desktop storage device that is inexpensive to manufacture.

To the accomplishments of the foregoing objects and advantages, the present invention, in brief summary, comprises an elongated platform element adapted to be inserted and retained within an elongated container. The elongated platform element includes a lower platform upon which said pens, pencils and similar elongated objects rest, and an upper platform connected to the lower platform by means of an elongated connecting member. Disposed within the upper platform is at least one aperture, said aperture serving to allow the pens or pencils to be inserted therethrough, and further allowing the user to grasp the elongated platform in order to slide it out of the container. The elongated platform element is adapted to be inserted into and securely retained within the container. Pens and pencils may be inserted through the aperture in the upper platform, and thereupon come to rest on the lower platform, being bound by the interior surface of the container. In order to receive said pens, pencils and the like, the elongated platform element is withdrawn from the container by means of grasping the aperture, thereby exposing the items stored within the container. In the preferred embodiment, the desktop storage device is composed of a foam rubber-type material, which material provides the storage device some flexibility and protection from everyday wear and tear.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
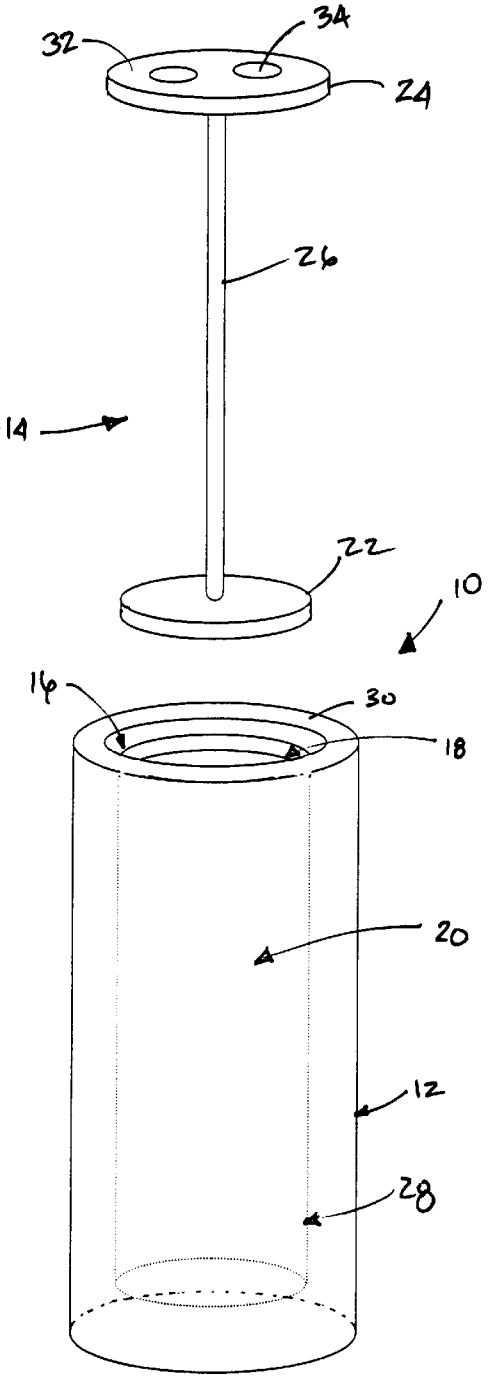
FIG. 1 is an exploded perspective illustration of the desktop storage device of the present invention showing the container and the elongated platform element.

Referring to the drawings and, in particular, to FIG. 1 thereof, the desktop storage device of the present invention is provided and is referred to generally by reference numeral 10. The desktop storage device 10 comprises a container 12 and an elongated platform element 14, adapted to be inserted and stored within said container 12.

In the preferred embodiment, the desktop storage device 10 is composed of a semi-rigid, yet flexible material such as foam rubber, which material allows the desktop storage device 10 to be easily and inexpensively produced, while allowing the desktop storage device 10 to withstand the general wear and tear that is common to similar organizers. In addition, the foam rubber material allows the desktop storage device 10 to be utilized as a storage means for pushpins, pins, needles and the like, by allowing these items to be inserted, point first, into the surface of the desktop storage device 10, without damaging the desktop storage device 10, or the materials or items stored therein. Furthermore, the high coefficient of friction of foam rubber serves to prevent the desktop storage device 10 from sliding on the surface of the desktop The container 12 includes an opening 16 through which the elongated platform element 14 may be inserted. Disposed below said opening 16 is an edge 18, which edge 18 serves to define the perimeter of the concavity 20 within said container 12. It should be appreciated that because of said edge 18, the area of the concavity 20 is less than the area of the opening 16. Accordingly, in the preferred embodiment, in which the container 12 is cylindrical and the opening is therefore circular, the diameter of the opening 16 will be greater than the diameter of the concavity 20.

Figure 2:
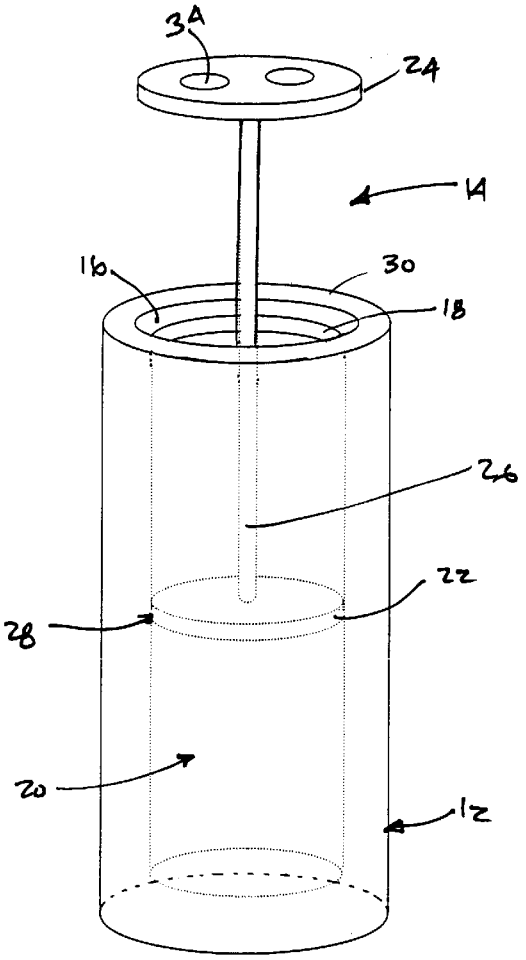
FIG. 2 is a perspective illustration the desktop storage device of the present invention showing the elongated platform inserted within the container.

The elongated platform element 14 comprises a lower platform 22 attached to an upper platform 24 by means of a connecting member 26. The shape and size of the lower platform 22 is the same as, or marginally smaller than, the shape and size of the concavity 20 such that, when said elongated platform element 14 is inserted within said container 12, the lower platform 22 will come into contact with the outer surface 28 of the concavity 20, as shown in FIG. 2. Thus, in the preferred embodiment where the container is cylindrical, the lower platform will by circular, and have the same, or slightly smaller, diameter as the cylindrical concavity 20.

Any space between the lower platform 22 and the outer surface 28 of concavity 20 must be kept to a minimum, as the pens, pencils and similar elongated objects rest upon the lower platform 22 during storage, and may become trapped within the container 12 if they get caught between an space between platform 22 and surface 28.

The shape and size of the upper platform 24 is the same as, or marginally smaller than, the shape and size of the opening 16 in the container 12, but larger in size than the area of the concavity 20 as defined by the edge 18. Therefore, when the elongated platform element 14 is inserted within said container 12, the lower platform 22 will come into contact with the outer surface 28 of the concavity 20, but contact by the upper platform 24 with edge 18 will prevent the elongated platform element 14 from being inserted too far within the container 12. Alternatively, no edge 18 may be provided and the shape and size of the upper platform 24 will be identical to that of the lower platform 22.

In the preferred embodiment, the height of the upper platform 24 is substantially the same as the distance between the upper surface 30 of the container 12 and the edge 18, such that, when the elongated platform element 14 is fully inserted within the container 12, the upper platform upper surface 34 will be flush with the upper surface 30 of the container.

The length of the connecting member 26 is sufficient so as to allow pens, pencils and the like to be stored between the upper platform and the lower platform. It should be appreciated, of course, the length of the concavity 20 must be at least as long as the length of the connecting member 26 added to the height of the lower platform 22 and the upper platform 24.

Disposed within the upper platform 24 is at least one aperture 34 through which the pens, pencils and similar objects may be inserted. The diameter of aperture 34 must be sufficient so as to allow the passage of the objects meant to be stored within the desktop storage device 10 therethrough, as well as allowing the insertion of a finger so as to provide a grasping point in order to lift the elongated platform element 14 from the container 12. However, the diameter of aperture 34 should not be so great that, in the event the desktop storage device 10 is dropped or overturned, all of the objects stored therein may easily be ejected through the large aperture 34.

In operation, the elongated platform element 14 of the desktop storage device 10 is inserted completely within the container element 12. Pens, pencils and similar objects are inserted through the aperture 34 of the upper platform 24 and come to rest on the lower platform 22. These objects are bound within the container 12 by the outer surface 28 of the concavity 20 on the sides, the lower platform 22 on the bottom, and the upper platform 24 on the top in order to gain access to the objects stored within the desktop storage device 10, the elongated platform device 14 is withdrawn from the container 12 by means of grasping the upper platform 24 using the aperture 34. As the elongated platform device 14 is withdrawn from the container 12, the items stored within are eventually revealed.

It should be appreciated that while in the preferred embodiment the shape of the desktop storage device 10 is cylindrical, there is no limit to the shape and size of the storage device 10, including rectangular, triangular or star-shaped, to name but a few.

Having thus described the invention with particular reference to the preferred forms thereof, it will be obvious that various changes and modifications can be made therein without departing from the spirit and scope of the present invention as defined by the appended claims.

We claim:

1. A desktop storage device for receiving and retaining elongated desktop items, said storage device comprising:

an elongated platform element for receiving said elongated desktop items including an upper platform and a lower platform connected by a connecting member;

an elongated container having an opening thereto, said opening providing access to a cavity within said elongated container, wherein said opening corresponds in terms of size and shape to said lower platform, and further wherein said cavity is at least as long as said elongated platform element, such that said elongated platform element may be slidably inserted and retained within said elongated container so as to enclose said elongated platform and thereby retain said elongated desktop items within said cavity, said container further including an upper portion defining said opening said upper portion having a shoulder situated immediately adjacent to said opening, wherein the diameter of said upper platform is substantially the same as the diameter of said shoulder such that said upper platform fits within said shoulder.

2. The desktop storage device of claim 1, wherein said desktop storage device is composed of a material adapted to receive pin-type securing devices without damaging said organizer and said desktop items.

3. The desktop storage device of claim 2, wherein said material is foam rubber.

4. The desktop storage device of claim 1, wherein said desktop storage device is cylindrical in shape.

5. The desktop storage device of claim 1, wherein said container is cylindrical in shape and said upper platform and said lower platform are circular in shape, said container including an inner surface and an outer surface, wherein the diameter of said lower platform is substantially the same as the diameter of said opening such that said lower platform slidably engages said inner surface when said elongated platform member is inserted within said container.

6. The desktop storage device of claim 5, wherein the diameter of said upper platform is substantially the same as the diameter of said lower platform.

7. The desktop storage device of claim 5, wherein the diameter of said upper platform is larger than the diameter of said lower platform.

8. The desktop storage device of claim 1, said upper platform further including at least one aperture adapted to allow passage of said elongated desktop items therethrough.

9. A desktop storage device for receiving and retaining elongated desktop items, said storage device being composed of a semi-rigid, yet flexible materials and comprising:

an elongated platform element for receiving said elongated desktop items including an upper platform including at least one aperture adapted to allow passage of said elongated desktop items therethrough, and a lower platform connected by a connecting member, said upper platform and said lower platform being circular in shape;

a cylindrical elongated container having an opening thereto, said opening providing access to a cavity within said elongated container, wherein said opening corresponds in terms of size and shape to said lower platform, and further wherein said cavity is at least as long as said elongated platform element, such that said elongated platform element may be slidably inserted and retained within said cylindrical elongated container having an inner surface and an outer surface, and further having an upper portion having a shoulder therein, wherein the diameter of said lower platform is substantially the same as the diameter of said opening such that said lower platform slidably engages said inner surface when said elongated platform member is inserted within said container, and further wherein the diameter of said upper platform is substantially the same as the diameter of said shoulder such that said upper platform fits within said shoulder so as to enclose said elongated platform and thereby retain said elongated desktop items within said cavity.

* * * * *